US006102457A

United States Patent [19]

Smith

[11] Patent Number: 6,102,457

[45] Date of Patent: Aug. 15, 2000

[54] SYSTEM FOR COLLECTION AND DISPOSAL OF PET WASTE OR COMPOSTABLES

[76] Inventor: Barbara Ruth Smith, 821 N. Aurora St., Ithaca, N.Y. 14850

[21] Appl. No.: 09/277,268

[22] Filed: Mar. 26, 1999

[51] Int. Cl.[7] ..... A01K 29/00

[52] U.S. Cl. ..... 294/1.3; 383/1

[58] Field of Search ..... 294/1.3–1.5, 55; 383/1; 15/104.8, 257.1, 257.6

[56] References Cited

U.S. PATENT DOCUMENTS

| | | | |
|---|---|---|---|
| 3,279,511 | 10/1966 | Griffin, Jr. | 383/1 |
| 3,767,247 | 10/1973 | Wetzler | 294/1 |
| 3,837,696 | 9/1974 | Dahlke | 294/1 |
| 4,042,269 | 8/1977 | Skermetta | 294/1.5 |
| 4,136,798 | 1/1979 | Oberstein | 220/408 |
| 4,186,955 | 2/1980 | Campbell | 294/1.3 |
| 4,205,869 | 6/1980 | Mathis | 294/1.3 |
| 4,620,999 | 11/1986 | Holmes | 428/35 |
| 4,645,251 | 2/1987 | Jacobs | 294/1.3 |
| 4,948,266 | 8/1990 | Bencic | 294/1.3 |
| 5,217,576 | 6/1993 | Van Phan | 162/158 |
| 5,241,919 | 9/1993 | LaGreca | 112/410 |
| 5,568,955 | 10/1996 | Giuliano | 294/1.3 |
| 5,704,670 | 1/1998 | Surplus | 294/25 |
| 5,716,692 | 2/1998 | Warner et al. | 428/153 |
| 5,858,554 | 1/1999 | Neal et al. | 428/537.5 |

FOREIGN PATENT DOCUMENTS

| | | | |
|---|---|---|---|
| 2055507 | 5/1993 | Canada | 294/1.3 |
| 2587-876 | 4/1987 | France | 294/1.3 |

OTHER PUBLICATIONS

Pet Star, 19 Stanford Drive, Rancho Mirage, CA 92270 web site http://petscoop.com (features and advertises PET SCOOP™ portable pooper scooper). (No date).

*Primary Examiner*—Dean J. Kramer
*Attorney, Agent, or Firm*—Brown, Pinnisi & Michaels, P.C.

[57] ABSTRACT

A system and method for the individual collection and disposal of pet waste includes a flushable bag for contacting and receiving the pet waste and a protective bag for receiving and protecting the flushable bag during transport. The pet waste is collected and placed in the flushable bag, the flushable bag is placed inside the protective bag, and the bags containing the pet waste are transported to a toilet into which the flushable bag is deposited and flushed. The flushable bag can be fabricated from paper having a temporary wet strength additive that imparts both the desirable wet strength and decayability when soaking in water. The invention also includes a compostable bag for disposing of compostable materials along with the bag itself in a composting system or composting toilet. The invention expedites the disposal of pet waste or compostable materials and decreases the burden on landfills to accommodate such materials. The invention provides an inexpensive and simple alternative to costlier and more complicated pet waste disposal systems and helps eliminate the detrimental impact of pet waste on the environment.

9 Claims, 4 Drawing Sheets

FIG. 4a
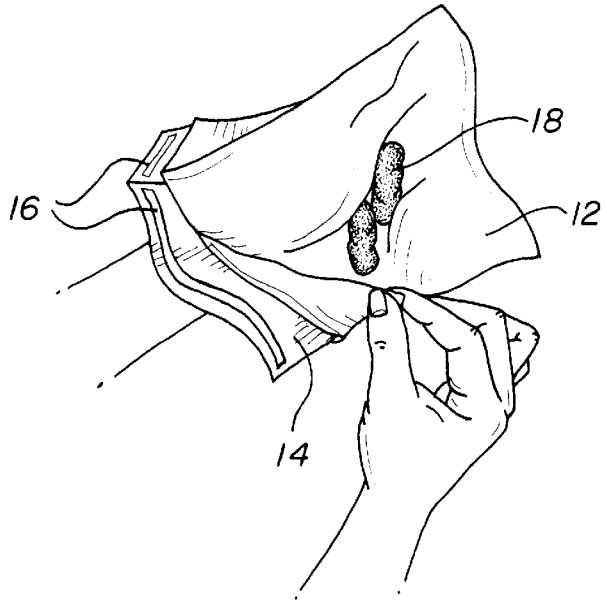
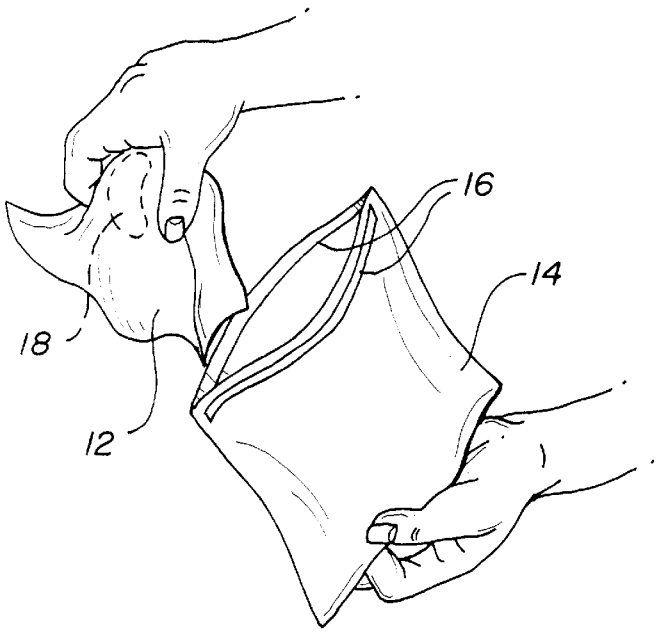
FIG. 4b
FIG. 4c
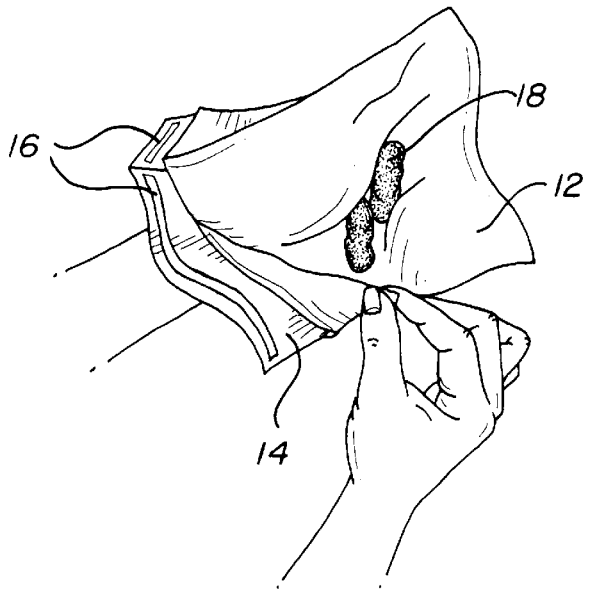

SYSTEM FOR COLLECTION AND DISPOSAL OF PET WASTE OR COMPOSTABLES

FIELD OF THE INVENTION

The invention pertains to the field of systems for collection and disposal of small amounts of waste products. More particularly, the invention pertains to systems for the collection and disposal of pet droppings and compostable materials.

BACKGROUND OF THE INVENTION

Pet owners who do not own large land tracts or who do not live in rural areas are generally subject to regulations requiring them to immediately pick up and dispose of pet droppings deposited outdoors. Other pet owners not necessarily required by law to properly dispose of pet waste also often clean up after their pets from a sense of obligation or social pressure. Owners with indoor pets such as cats also contend with the problem of pet waste and its proper disposal. Various systems, devices and kits have been devised to facilitate handling and disposal of pet waste.

U.S. Pat. No. 5,704,670 discloses a glove bag with an enlarged cuff portion that serves as a bag. The glove bag may be everted one or more times and includes sealing means.

U.S. Pat. No. 5,568,955 discloses a device formed to fit on the hand and having a portion that can be inverted to produce a bag-like structure holding excrements inside.

U.S. Pat. No. 4,645,251 discloses a system including a flexible inner glove and a flexible, disposable outer glove that may optionally include attached absorbent layers such as absorbent paper and that is invertable for containing the waste material.

U.S. Pat. No. 3,837,696 discloses a glove-like device that can be provided as a stacked packet to dispense for use and that optionally may be made from paper.

U.S. Pat. No. 3,767,247 discloses a flexible, bag-like receptacle having a portion that can be inverted and tied off to hold pet droppings. It also discloses a scoop for collecting the droppings and inserting them into the receiving portion.

A problem in common with such systems or devices is that the receptacle, bag or other device containing the pet waste is only designed to be placed in the trash from where it generally is taken to a landfill. This can result in unsanitary conditions should the trash spill or somehow be exposed before or while being transported to the landfill. Another problem of greater scope is that the disposed pet waste occupies some of the landfill volume, which considering the large number of pets producing tons of waste on a daily basis imposes an associated fiscal and environmental impact that over time can become significant.

SUMMARY OF THE INVENTION

The invention provides a system and method for the individual collection and disposal of pet waste that includes a flushable bag for contacting and receiving the pet waste and a protective bag for receiving and protecting the flushable bag during transport. This allows the pet waste to be collected at a first location where it is placed in the flushable bag, the flushable bag to be placed inside the protective bag, and the bags containing the pet waste transported to a toilet into which the flushable bag is deposited and flushed. The invention also includes the method of using the pet waste bags in this manner.

The invention is further directed to a bag that is both compostable and flushable and therefore suitable for either application, in order to dispose of compostable materials in a composting system capable of receiving and composting both the compostable materials and the compostable bag.

The invention expedites the disposal of pet waste, or compostable materials, and reduces the interval during which persons may be exposed to accompanying or developing unsanitary conditions such as when home trash is spilled or exposed in some manner. The invention also eliminates the need to employ makeshift or improvised means for collection and disposal of pet waste, for example with a handful of toilet paper or a paper towel that might break, leak through, or clog up a toilet.

The invention is an inexpensive and simple alternative to costlier and more complicated pet waste disposal systems. The invention advantageously redirects pet waste from landfills to existing sanitary sewer systems best equipped to deal with organic waste, thus preserving valuable landfill space for other forms of waste or trash and helping eliminate the detrimental impact of pet waste on the environment.

The invention provides a convenient alternative for disposing of many forms of pet excrement, including but not limited to that of dogs, cats, rabbits, and hamsters.

BRIEF DESCRIPTION OF THE DRAWINGS

FIGS. 4*a* and *c* show perspective views of a flushable bag over a protective bag while collecting waste, and 4*b* shows a perspective view of a flushable bag and contents being placed inside a protective bag, as in the invention.

DESCRIPTION OF THE PREFERRED EMBODIMENTS

Figure 1:
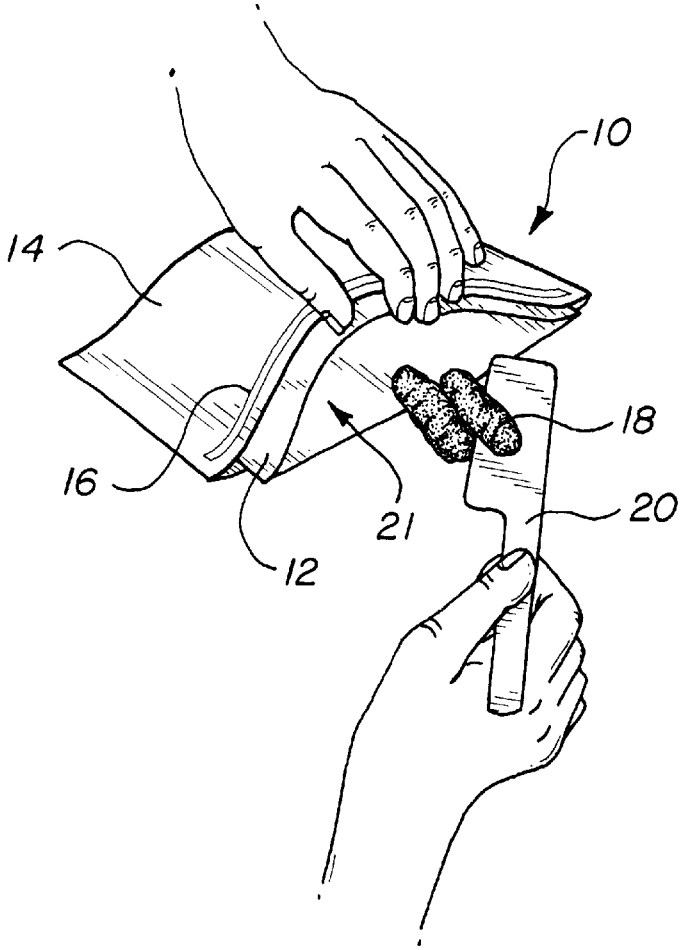
FIG. 1 shows a perspective view of a flushable bag inside a protective bag with the bags opened and with a pusher device being used to push waste into the inner bag as in the invention.
Figure 2:
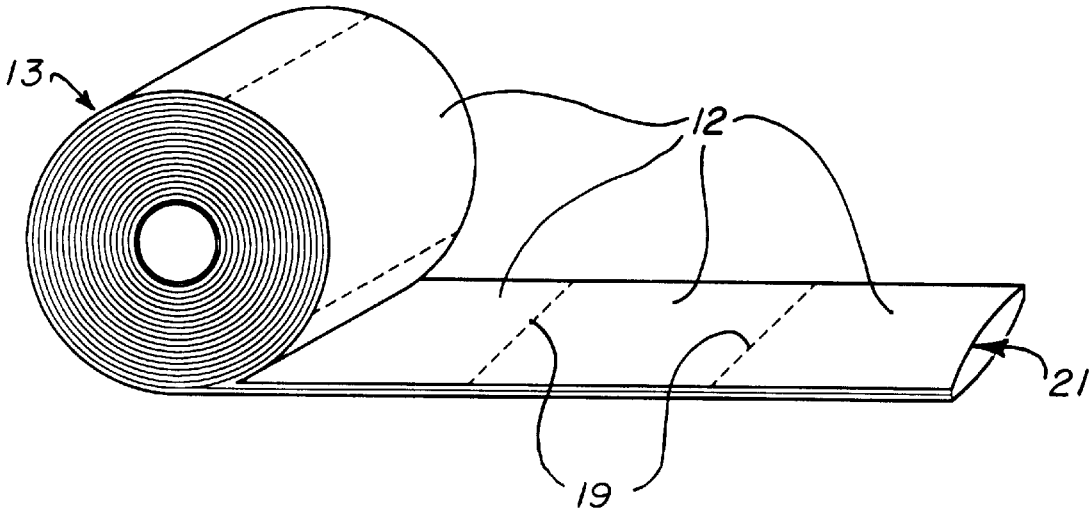
FIG. 2 shows a perspective view of a roll of flushable pet waste bags as in the invention.

As shown in FIGS. 1–8, system 10 for collecting and disposing of pet excrement comprises flushable bag 12 and protective bag 14. "Flushable" as used herein requires that bag 12 have certain properties discussed further below and can therefore include bags 12 fabricated from both suitable papers and suitable non-paper materials, as will be made clear from the accompanying description. Bag 12 may be provided in the form of single bags, or as shown in FIG. 2 as a plurality of interconnected bags 12 in roll 13 or in sheet form with bags 12 removably attached to one another. Bags 12 may be joined end-to-end and individually removable along a weakened, punched, creased, or perforated edge 19 to expose opening 21 of the leading attached bag 12, or in another embodiment (not illustrated) releasably joined at one end along an outer surface, for example at an open, top end such as with double-handled plastic grocery bags disposed on supporting stands at supermarket checkout counters or the like. As with the latter type of bag, bag 12 similarly may be provided with integral handles, ties, or flaps (not illustrated).

Bag 12 and/or bag 14 may be provided in a pop-up dispenser type of package similar to a tissue box or box of plastic bags that have an opening by which to access and grasp the lead bag. Similarly, bags 14 can be provided either individually or in a roll or sheet form.

As shown in FIG. 1, bag 12 is placed inside bag 14 and protrudes to facilitate collecting waste 18 with pusher device 20. Afterward, bag 12 can be urged inside bag 14 and bag 14 sealed for transport to a toilet. Bag 14 preferably includes closure means 16 disposed along the open end, such as a Ziploc® type of closure device, or other suitable such means such as ties, adhesive strips, or zippers and the like, to seal bag 14 and decrease or eliminate exposure to offensive odors and pathogens in waste 18.

In the embodiments shown in FIGS. 4*a* and 4*c*, bag 12 is placed over bag 14, optionally with bag 14 already inverted as in the latter figure to avoid possible contamination or wetting of its outer surfaces, and after inserting a hand in bag 14 waste 18 can be gathered on to an outer surface of bag 12. Bag 12 can then be grasped at the open end with the free hand as shown and in one motion peeled off bag 14 and inverted to enclose waste 18 inside bag 12. Bag 12 can then be placed inside bag 14 as shown in FIG. 4*b* to transport waste 18 to a toilet with bag 14 protecting the person from contact with waste 18 from the initial gathering step to final disposal and flushing into the waste treatment system.

Figure 3A:
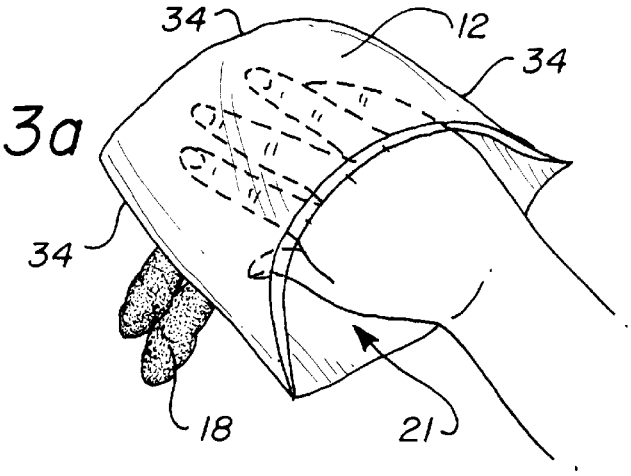
FIGS. 3*a* and 3*b* show perspective views of a flushable bag and a protective bag as in the invention.
Figure 3B:
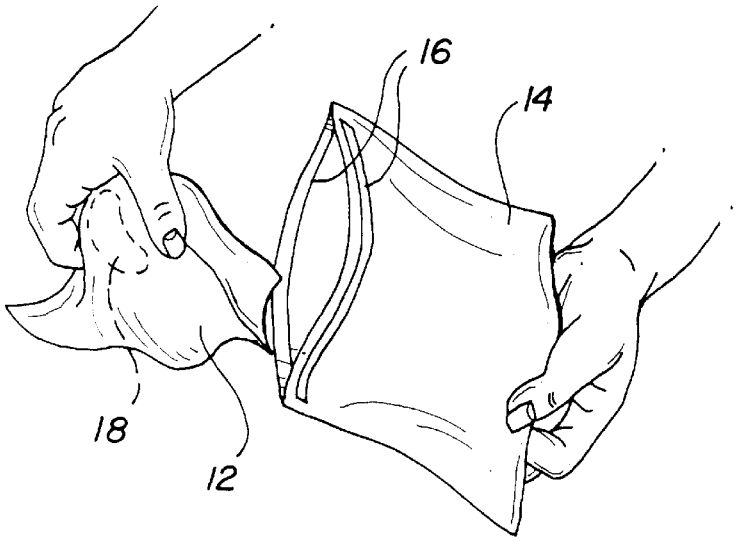

Bag 12 may also be used separately from bag 14, for example as shown in FIGS. 3*a* and 3*b*, bag 12 is used to collect waste 18 and inverted or reinverted with waste 18 inside. Bag 12 can then either be placed inside bag 14 as above, or for situations involving short distance transport such as inside the home when quickly disposing of cat litter box waste or the like, bag 12 with its contents can be taken directly to a toilet for disposal. The invention thus provides another advantage over other cat waste disposal systems because bag 12 traps loose and clinging cat litter until it exits the toilet bowl into the septic system along with bag 12, eliminating the need to clean the bowl of litter that is not amenable to flushing.

Figure 6:
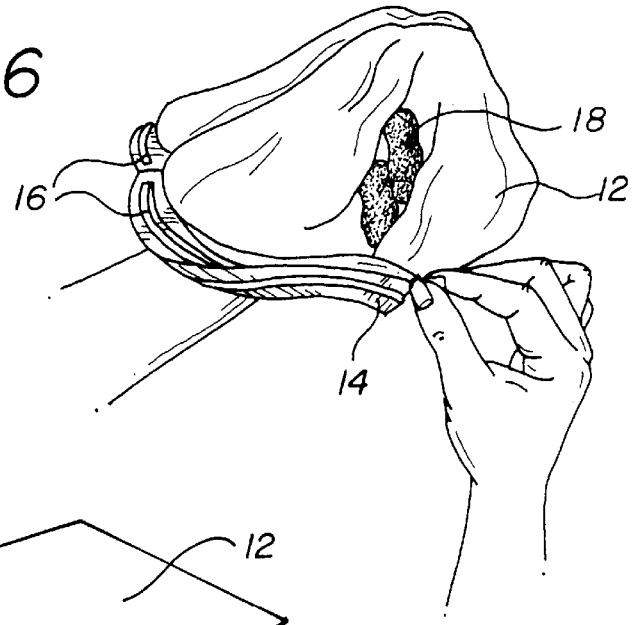
FIG. 6 shows a perspective view of a flushable bag and protective bag inverted together as in the invention.

In another embodiment, bag 12 is placed inside bag 14, and as shown in FIG. 6 bags 12 and 14 are inverted to expose bag 12 and a hand inserted inside inverted bag 14. Waste 18 is then collected on to bag 12 and the bags reinverted with waste 18 now inside bag 12 and bag 12 inside bag 14. Bag 14 can then be sealed and its contents transported to be disposed of.

Figure 8:
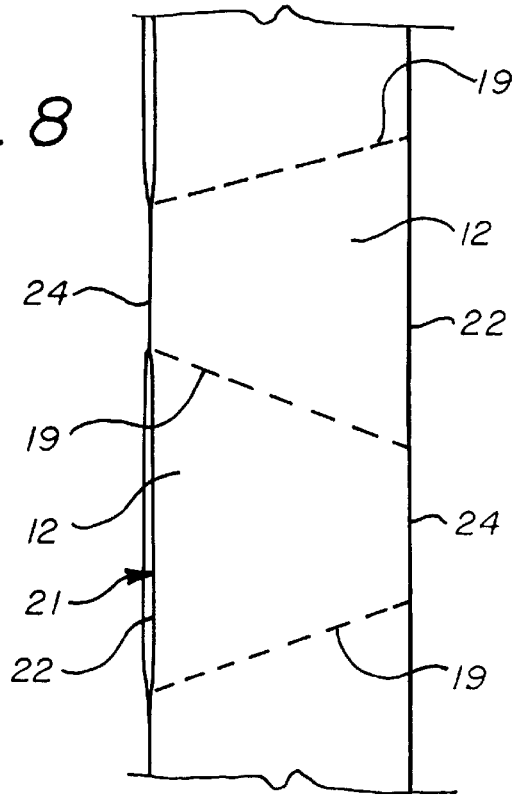
FIG. 8 shows a perspective, partially fragmentary view of a sheet of flushable pet waste bags as in the invention.

Bags 12 and 14 may be square, rectangular, glove-shaped, mitten-shaped, that is having just a thumb-receiving portion adjacent to a central pouch space, or have other shapes suitable for the particular embodiment of practicing the invention. FIG. 8 shows a sheet of trapezoidal-shaped bags 12 removably interconnected at perforations or creases 19 with each bag 12 sealed along threes sides and having opening 21 at wide edge 22. This geometry facilitates insertion of a hand into opening 21 since bag 12 conforms to the hand, and it also facilitates inverting bag 12 by pulling longer edge 22 over sealed shorter edge 24.

Figure 7:
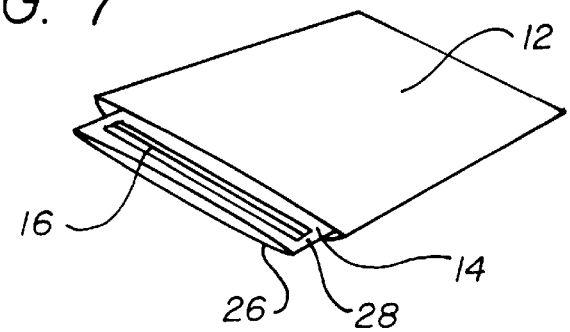
FIG. 7 shows a perspective view of a flushable bag and protective bag as in the invention.

Bags 12 and 14 can be provided in a common dispenser and dispensed together, as for example with bag 12 inside bag 14 as shown in FIG. 1 or with bag 14 inside bag 12 as shown in FIG. 7. In the latter embodiment, Ziploc® or other similar closure means 16 can be disposed on outer surfaces 26 and 28 of bag 14. Bags 12 and 14 can be dispensed flat as shown, and after collecting waste 18, the bags are inverted together with closing means 16 now situated on the inside of bag 14 and the contents sealed inside, this having been accomplished in a single, unified inverting step.

Figure 5:
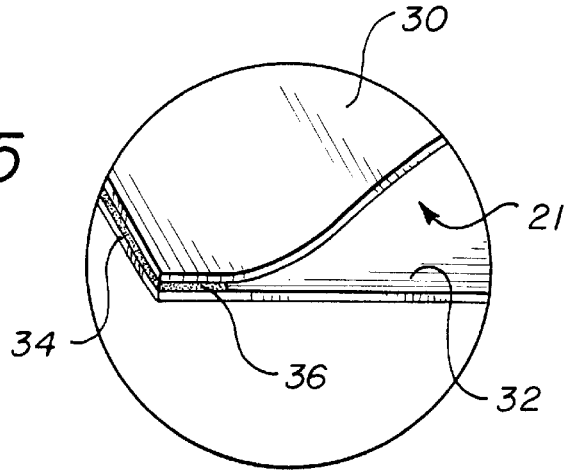
FIG. 5 shows a perspective, partially fragmentary view of a flushable bag as in the invention.

As shown in FIG. 5, bag 12 comprises two flushable paper webs 30 and 32 joined together along three sides 34 with fourth side opening 21. Layer 36 joins webs 30 and 32 along sides 34 and is preferably a water soluble adhesive or other suitable material such that when bag 12 is disposed of in a toilet, webs 30 and 32 readily separate and decay as described below. Alternatively, sides 34 may be mechanically joined as by stitching, stapling, deep embossing or tacking, or may be sealed using an appropriate adhesive, spray bond, seaming tape, or other suitable technique or combination of techniques.

In one embodiment, layer 36 comprises a water soluble plastic such as polyvinyl alcohol film as described in U.S. Pat. No. 2,365,315, incorporated herein by reference, preferably a cold water soluble plastic foil such as Solvy™ manufactured by Aquafilm, LTD. and sold by Sulky of America, Inc that is capable of joining webs 30 and 32 when edges 34 are joined by steaming or another suitable process. Layer 36 can alternatively comprise a water-soluble adhesive gel such as is available from Elmer's®, Inc.

Webs 30 and 32 should comprise a flushable paper having sufficient structural integrity to allow bag 12 to be carried from the pet waste collection site to a toilet without bag 12 disintegrating in the process. Suitable papers for bag 12 include those typically used to manufacture flushable tissue or toilet paper and can accordingly comprise papermaking fibers derived from wood pulp in all its varieties. Suitable wood pulps may include chemical pulps and mechanical pulps such as are well known in the art. Other suitable materials for fabrication can include cellulosic fibrous pulps, also well known in the art.

The paper should include one or more temporary wet strength additives that impart sufficient wet strength to the paper while permitting bag 12 to decay upon soaking in water, thus facilitating passage of bag 12 and the pet excrement through the septic or sewage system. The paper may also include various non-fibrous materials such as fillers and adhesives or other materials employed during papermaking or when converting the paper into the finished product, for example a two-ply tissue paper. In a preferred embodiment, the paper consists essentially of these components that lend it these temporary wet strength and decay-on-soaking properties, that is, paper bag 12 preferably does not include a substantial amount of one or more permanent wet strength additives or other materials such as polymeric materials that do not decay rapidly when soaked. Suitable temporary wet strength resins include Caldas 10 (manufactured by Japan Carlit) and CoBond 1000 (manufactured by National Starch and Chemical Company) and other additives of this type that provide a temporary wet strength property.

Tissue paper useful for fabricating bag 12 includes single-ply, two-ply, and other plies or thicknesses capable of providing both the structural integrity and the breakdown in water characteristics as discussed above. The tissue paper may be embossed or plain the choice of which may depend on a variety of factors such as the desired thickness, tear-resistance, or absorbency, to name but a few.

Protective bag 14 is preferably waterproof or nonabsorbent to provide protection from contact with the pet waste and to protect paper bag 12 from contact with rain or moisture that could prematurely degrade bag 12 prior to disposal. Although bag 14 may be transparent, it is preferably opaque or colored to hide the contents from view since bag 12 may be subject to unsightly discoloration from its contents until ultimately disposed of. Bag 14 is preferably flexible plastic and can comprise polyethylene or other suitable polymeric or copolymeric materials, and films and laminates made therefrom, as are well known in the art. Alternatively, bag 14 may comprise a fabric having a suitable waterproofing constituent as are well known in the art.

The invention can include pusher device 18 as discussed above or other means for collecting and depositing the pet waste into or against bag 12, such as a scooping implement or paddle or the like. The invention can comprise a kit including bags 12 and optionally bag or bags 14, with or without means for collecting the pet waste. The kit may include a plurality of bags 12 and 14, provided individually, in the form of rolls or stacks, or in a dispenser or dispensers, or a supply of bags 12 with a washable, reusable bag 14. The kit can further comprise a carrying device such as a shoulder or belt-strapped pouch (not illustrated) or the like. The kit, or other marketed product, may include a reminder that bag 12 is flushable printed directly on a surface of bag 12 or protective bag 14, or included elsewhere in the kit or the product.

Paper suitable for fabricating bag 12 may include fibers derived from recycled paper, or may comprise recycled fragments held together with a temporary or soluble cement or binding agent. Material suitable for fabricating bag 12 also includes suitable non-paper materials providing the necessary flushable and temporary wet strength characteristics as described above. For example, a water soluble polymer film or plastic foil such as a Solvy™-type material as described above that dissolves when placed in cold water is a suitable material with which to fabricate bag 12.

In another embodiment of the invention, bag 12 is fabricated as above so as to be at once flushable and compostable. It can then be used for the collection of small amounts of organic material that needs to be transported to a composting site. Compostable material, including pet waste if the composting arrangement at the site is suitable for it, may then be picked up at a first location and placed in compostable bag 12, bag 12 then placed inside protective bag 14 as above, and the compostable material transported from the first location to a second location where bag 12 is removed from protective bag 14 and along with the compostable material is disposed of in a suitable composting area, device, system, or composting toilet. This embodiment comprises no materials that fail tests for toxicity, that are not biodegradable in the short term, or that interfere with the decomposition of other organic material in any way. Suitable materials for bag 12 include unbleached tissues, water soluble, non-toxic, organic or inert additives, binders or bond-makers, and cold water soluble, non-toxic polymer films such as the Aquafilm L series Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A system for individual collection and disposal of pet waste, comprising:

a flushable bag, suitable for contacting and receiving the pet waste, said flushable bag comprising a paper that includes a temporary wet strength additive, said flushable bag being readily decomposed in a sewage handling system; and;

a nonabsorbent protective outer bag, suitable for receiving and protecting the flushable bag during transport, such that when said flushable bag is placed inside said protective bag, leakage from said flushable bag cannot penetrate said protective outer bag, whereby the pet waste is collected at a first location and placed in the flushable bag, the flushable bag is placed inside the protective bag, and the bags containing the pet waste are transported to a toilet into which the flushable bag containing the pet waste is placed and then flushed.

2. A system as in claim 1, wherein the protective bag includes means for closing the protective bag.

3. A system as in claim 1, wherein the flushable bag comprises paper having at least two plies.

4. A system as in claim 3, wherein the flushable bag comprises two webs joined together along three sides and having an opening along a fourth side.

5. A system as in claim 1, wherein the paper has a density in the range of from about 0.04 g/cc to about 0.20 g/cc.

6. A system as in claim 1, further including means for collecting and depositing the pet waste in the flushable bag.

7. A system for individual collection and disposal of pet waste, comprising:

a flushable bag for contacting and receiving the pet waste, said flushable bag comprising a paper having at least two plies; and a temporary wet strength additive, wherein the flushable bag comprises two webs joined together along three sides and having an opening along a fourth side, wherein the two webs include a water soluble polymer film between the two webs along the joined sides; and a nonabsorbent protective bag for receiving and protecting the flushable bag during transport, whereby the pet waste is collected at a first location and placed in the flushable bag, the flushable bag is placed inside the protective bag, and the bags containing the pet waste are transported to a toilet into which the flushable bag containing the pet waste is placed and then flushed.

8. A system for individual collection and disposal of compostable material, comprising:

a compostable bag, suitable for contacting and receiving the compostable material, said compostable bag comprising a paper that includes a temporary wet strength additive, said bag being readily decomposed in a sewage handling system or a composting system; and a nonabsorbent protective outer bag, suitable for contacting and receiving the compostable bag and compostable material, such that when said compostable bag is placed inside said protective bag, leakage from said compostable bag cannot penetrate said protective outer bag, when the compostable material is picked up at a first location and placed in the compostable bag, the compostable bag is placed inside the nonabsorbent protective outer bag, and the compostable material transported from the first location to a second location at which the compostable bag is removed from the nonabsorbent protective outer bag and, still containing the compostable material, disposed of in a composting area, composting device, or toilet.

9. A system for individual collection and disposal of pet waste, comprising:

a flushable bag for contacting and receiving the pet waste, said flushable bag comprising a water soluble polymer film; and a nonabsorbent protective bag for receiving and protecting the flushable bag during transport, whereby the pet waste is collected at a first location and placed in the flushable bag, the flushable bag is placed inside the protective bag, and the bags containing the pet waste are transported to a toilet into which the flushable bag containing the pet waste is placed and then flushed.

* * * * *